United States Patent [19]

Bell, III et al.

[11] Patent Number: 4,791,770

[45] **Date of Patent: * Dec. 20, 1988**

[54] SUBPURLIN AND ATTACHMENT ASSEMBLY

[75] Inventors: John R. Bell, III, Germantown; Robert E. Hodges, Jr., Memphis, both of Tenn.

[73] Assignee: AMCA International Corporation, Hanover, N.H.

[ * ] Notice: The portion of the term of this patent subsequent to Jun. 30, 2004 has been disclaimed.

[21] Appl. No.: 67,535

[22] Filed: Jun. 29, 1987

Related U.S. Application Data

[63] Continuation-in-part of Ser. No. 794,076, Nov. 1, 1985, Pat. No. 4,676,042.

[51] Int. Cl.[4] ..... E04D 1/34

[52] U.S. Cl. ..... 52/543; 52/478

[58] Field of Search ..... 52/478, 508, 543, 573, 52/698, 741

[56] References Cited

U.S. PATENT DOCUMENTS

| | | | |
|---|---|---|---|
| 3,031,044 | 4/1962 | Stitt et al. | 189/34 |
| 3,332,186 | 7/1965 | Cammaert | 52/302 |
| 3,394,516 | 7/1965 | Taylor et al. | 52/410 |
| 3,975,880 | 8/1976 | Fischer, Jr. | 52/464 |
| 3,998,019 | 12/1976 | Reinwall, Jr. | 52/478 |
| 4,081,938 | 4/1978 | Bertacchi et al. | 52/410 |
| 4,114,338 | 9/1978 | Beck | 52/478 |
| 4,155,206 | 5/1979 | Player | 52/478 X |
| 4,329,823 | 5/1982 | Simpson | 52/407 |
| 4,361,993 | 12/1982 | Simpson | 52/222 |
| 4,406,106 | 9/1983 | Dinges | 52/478 |
| 4,466,224 | 8/1984 | Hague | 52/478 |
| 4,486,998 | 12/1984 | Hague | 52/478 |
| 4,594,823 | 6/1986 | Hague | 52/543 X |
| 4,651,489 | 3/1987 | Hodges et al. | 52/409 |
| 4,676,042 | 6/1987 | Bell, III et al. | 52/543 |

*Primary Examiner*—David A. Scherbel
*Assistant Examiner*—Creighton Smith
*Attorney, Agent, or Firm*—Richards, Harris, Medlock & Andrews

[57] ABSTRACT

A subpurlin (100) is provided for use in constructing an insulated wall assembly having a plurality of horizontal support members (104) and wall panels (102). The subpurlin (100) is provided with a first cell rib area (110) and a second cell rib area (112) and interconnecting spanner sections (28) to provide insulation space (116) between the wall support members (104) and the subpurlin.

8 Claims, 4 Drawing Sheets

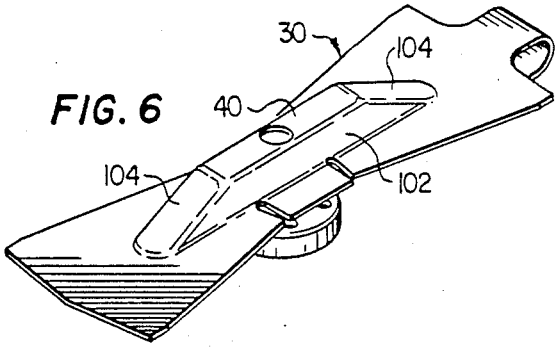
FIG. 6
FIG. 7
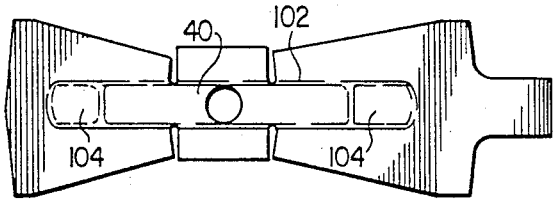
FIG. 8
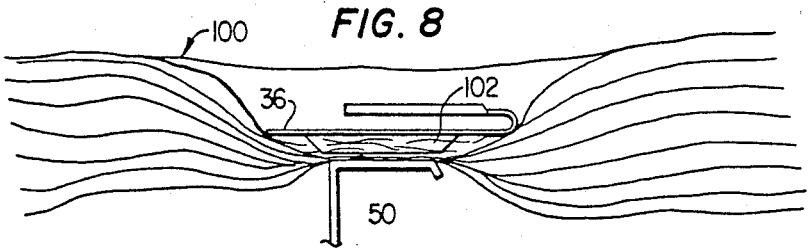
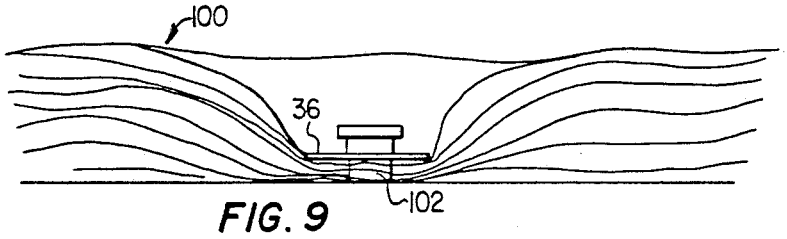
FIG. 9

SUBPURLIN AND ATTACHMENT ASSEMBLY

CROSS REFERENCE TO RELATED APPLICATIONS

This application is a continuation-in-part of U.S. patent application, Ser. No. 794,076, filed Nov. 1, 1985 U.S. Pat. No. 4,676,042.

FIELD OF INVENTION

This invention relates to metal building systems and, more particularly, to an intermediate subpurlin for spacing wall panels from a wall support structure.

BACKGROUND OF INVENTION

A typical roof structure for metal buildings includes a structural support system covered by a plurality of overlapping roof panels. Roof panels are generally formed from sheet materials to define ribs and other contours which provide rigidity and strength to the panels. Mating ribs may be provided where panels overlap for improved interlocking and weather integrity.

As a building heats and cools, the structural support system and the roof panels may experience dimensional changes from thermal expansion and contraction. There is frequently differential movement between the roof panels and underlying structure. Where the roof panels are rigidly fixed to the underlying structure, stresses and physical deformation can be produced in the roof panels, particularly along panel widths perpendicular to the panel ribs.

In a conventional building system, the roof panels are fastened to the underlying structure at low points or valleys in the panel contour. Water run-off and collection also occur along the panel valleys. Thus, the valley locations where fasteners penetrate the roof panels are often the source of water leakage and of roof panel degradation.

A building roof structure may also include an insulating layer between the structural support system and the overlying roof panels. The thickness of the insulating layer may be considerably reduced where the roof panels are fixed to the structure. Compressing the insulating layer thickness greatly decreases the insulating effectiveness of the layer.

U.S. Pat. No. 4,114,338 to Beck teaches a reinforcing plate for use beneath end lapped thin gauge sheets to provide structural support adjacent the joints for improved sealing. The reinforcing plate is elevated above the underlying insulation and is fastened to an underlying purlin through downwardly depending flanges having mounting slots therein. However, there is no provision to assure that the reinforcing plate is not rigidly fixed to the underlying structure. Further, the roofing sheets are fixed to the reinforcing plates along valleys where water run-off and collection can occur.

U.S. Pat. Nos. 4,361,993 and 4,329,823 to Simpson teach a support spacer apparatus for engaging an overlying ribbed panel in a manner to support the panel above the building support structure without compressing the underlying insulation. However, Simpson rigidly fastens the component parts together to provide for structural strength increases.

U.S. Pat. No. 3,332,186 to Cammaert does teach structure for enabling relative movements between corrugated sheet roofing and underlying rafters. Sliding members are fixed to raised corrugations and engage intermittent slideways which are fixed to the rafters to enable relative movements parallel to the corrugations. There is no suggestion about adapting the slider and slideway system to an insulated assembly.

Also, it is very desirable to insulate the walls of a building as well. The walls are typically formed by horizontal wall support members spaced a predetermined distance apart, with interior wall panels secured to the wall support members on the inside of the building and external wall panels secured to the wall support members on the exterior side of the members. In the past, insulation has been placed between the wall panels. However, the exterior wall panels have been typically secured directly to the wall support members, making insulation of the exterior wall nearly impossible at the juncture of the wall panels and support members.

These and other disadvantages in the prior art are overcome by the present invention wherein a subpurlin is provided in a contour effective to support roof panels without compressing underlying insulation while providing elevated fastening support areas and having a clip for slidably fasting the subpurlin to underlying support structure.

Further, it would be very desirable to achieve better insulation of the walls of a building as well. Particularly to insulate the entire wall area.

SUMMARY OF THE INVENTION

In accordance with one aspect of the present invention, a subpurlin is provided for interconnecting a structural assembly and a panel. The subpurlin includes an elongate member defining a plurality of low cell rib areas, each lying in a first plane with each low cell rib area having an aperture formed therein. The subpurlin further has a plurality of high cell rib areas lying in a second plane spaced from the first plane. Spanner sections interconnect the low and high cell rib areas with the spanner sections lying in a third plane positioned between the first and second planes. The first and third planes are sufficiently separated to permit thermal insulation to be effectively installed between the subpurlin and structural assembly.

In a first embodiment of the present invention, the subpurlin is provided for interconnecting a roof structural assembly and roof deck panels. The subpurlin apertures form slotted openings, each having a length which is effective to accommodate expansion and contraction movements of the roof deck panels relative to the underlying structural assembly. A connector is provided for slidably engaging the elongate member adjacent the roof structural assembly and beneath the roof deck panels. The connector includes a washer defining a bearing surface, and a ferrule which slidably engages a slotted opening in the elongate member, where the ferrule has a length which is effective to maintain the washer above the opening and in spaced relationship with the elongate member.

In accordance with another aspect of the present invention, a method for forming an insulated wall assembly over a plurality of wall structural members is provided. The method includes the step of placing insulating material along a surface of the wall structural members and placing a first subpurlin over the insulating material and extending along one of said structural members. The subpurlin has a plurality of interior cell areas defining apertures therethrough and a plurality of exterior cell areas. The exterior and interior cell areas are separated by a spanner sections effectively spaced exterior of the wall support member in a spaced relation from the wall member to permit the insulating material to insulate the space. Finally, the subpurlin is fastened to the wall structural member by a fastener through each aperture.

These and other characteristics of the present invention will become apparent from the following detailed description, wherein reference is made to the figures in the accompany drawings.

IN THE DRAWINGS

FIG. 6 is a perspective view of the underside of a connector forming one embodiment of the present invention illustrating the boss spacing the subpurlin sliding surface above the roof structural assembly.

FIG. 7 is a bottom plan view of the connector.

FIG. 8 is a side view of the connector mounted on the roof structural assembly illustrating the minimal compression of the insulation between the connector and the roof structural assembly.

FIG. 9 is an end view of the connector mounted to the roof structural assembly illustrating the minimum compression of the insulation therebetween.

DETAILED DESCRIPTION

Figures 1, 2, 3:
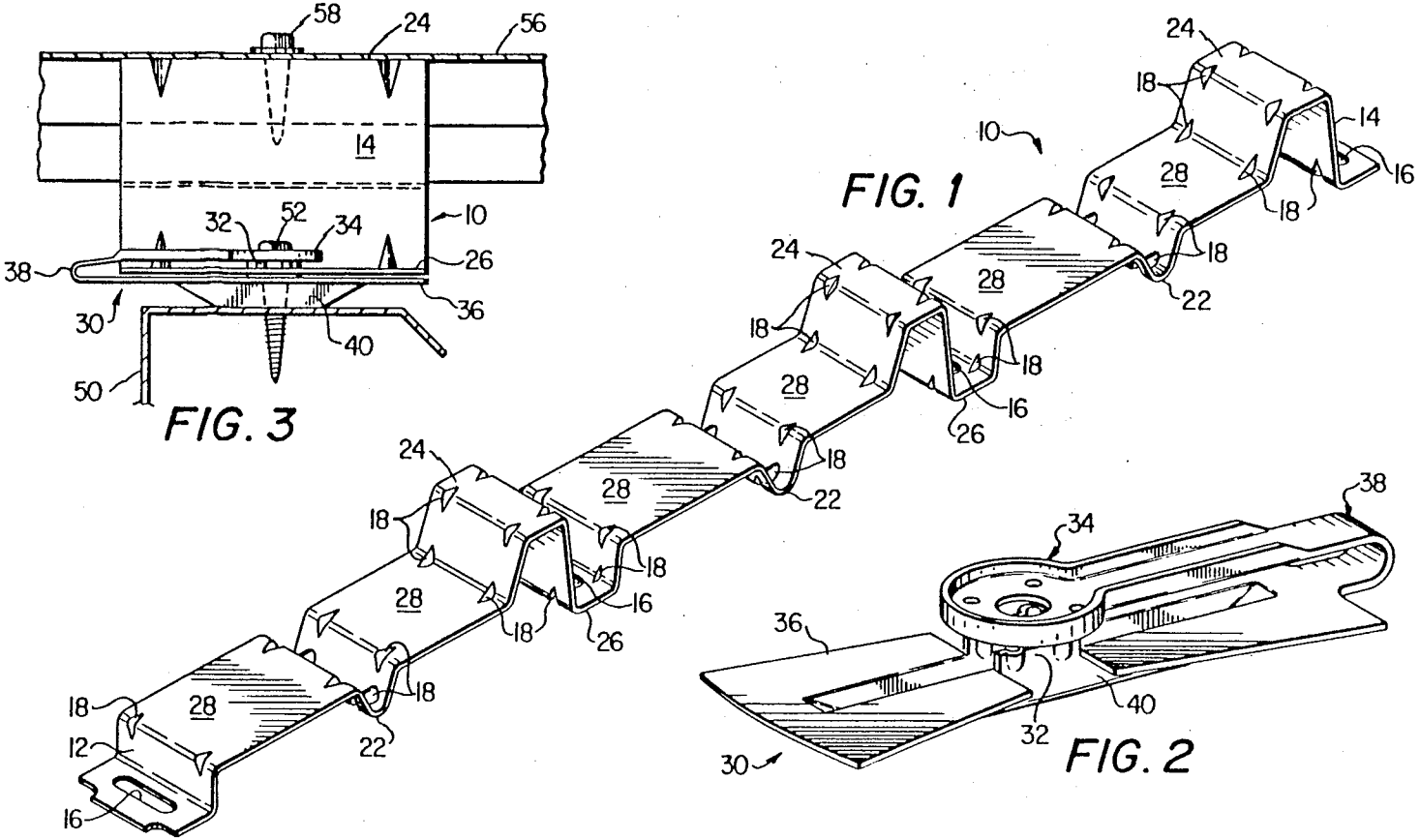
FIG. 1 is a pictorial illustration of one embodiment of a subpurlin in accordance with the present invention.
FIG. 2 is a pictorial illustration of one embodiment of a subpurlin fastening clip.
FIG. 3 is a side elevation in partial cutaway of an installed subpurlin with clip.

Referring now to the figures, and more particularly to FIG. 1, there is shown one embodiment of subpurlin 10 according to the present invention. Subpurlin 10 is formed as an elongate member having a lap end 12 and rib end 14. Lap end 12 mates with the rib end 14 of an adjacent subpurlin 10, as hereinafter explained. In a preferred embodiment, subpuriin 10 is about 36 inches long and three inches wide, a size consistent with conventional building materials.

Subpurlin 10 defines a plurality of expansion slots 16 along its length. An expansion slot is included at lap end 12 and rib end 14 and at intermediate locations where subpurlin 10 contacts the underlying support structure.

The configuration of the elongate subpurlin 10 includes intermediate bearing stiffeners 22, high cell ribs 24, low cell ribs 26 and connecting spanner sections 28. Spanner sections 28 are supported above underlying structural members by flanges at lap end 12 and rib end 14, by intermediate bearing stiffeners 22, and by low cell ribs 26. Bearing stiffeners 22 serve to provide the desired rigidity to spanner sections 28 at desired locations. Reinforcing embossments 18 provide additional strength at locations where subpurlin 10 is bent.

Preferably low cell ribs 26 further define slots 16. Slots 16 have a length which is effective to enable relative thermal expansion movements to occur between the overlying roof structure and the underling structural members, as hereinafter explained. High cell ribs 24 may be provided in a variety of configurations. It is desirable, however, that the selected configuration be comparable with elongate ribs of the overlying roof deck panels to provide for attaching the deck panels to the high cell ribs 24.

Referring now to FIG. 2, there is shown connecting slider assembly 30 for joining subpurlin 10 with the underlying structural members. Slider tab 32 is formed as a ferrule for engaging expansion slots 16 in subpurlin 10 (see FIG. 1). Washer 34 is paced above ferrule 32 and defines a bearing surface for use in fastening the assembly together, as hereinafter explained. As shown in FIG. 2, washer 34 is supported above ferrule 32 by connecting biasing arms 38 to form a unitary connector assembly 30 which is convenient for field installation.

Thus, referring to FIGS. 1 and 2, connecting slider assembly 30 is installed by urging washer 34 above a low cell rib area 26 of subpurlin 10 and along low cell rib 26 until ferrule 32 is engaged through expansion slot 16. Bottom sliding surface 36 may then be dimensionally formed to have the same length as the width of subpurlin 10 so that alignment is easily accomplished, either visually or by feel. Structural bearing surface 40 is placed adjacent an underlying structural assembly member, a fastener is inserted through washer 34 and ferrule 32, and the fastener is rotated to secure washer 34 against ferrule 32. While a threaded fastener 52 is shown, any suitable fastener can be used to suit the structural assembly member. A nail could be used when the structural assembly member is wood, for example. The dimensions of ferrule 32 are selected such that expansion slot 16 slidably engages ferrule 32 when washer 34 is clamped against ferrule 32. Thus, low cell rib areas 26 slidably engage bottom sliding surface 36 as the assembly is fastened to the underlying support structure.

Referring now to FIG. 3, there is depicted a side elevation, in partial cutaway, of a subpurlin 10 fastened through connector 30 to an underlying structural member 50. Structural member 50 may be a purlin or may be a primary structural member such as a bar joist. Biasing arms 38 have been spread to move connecting slider assembly 30 about rib end 14 (as shown in FIG. 1) until ferrule 32 has engaged through expansion slot 16 (not shown). Structural bearing surface 40 of slider assembly 30 is placed adjacent structural member 50 and fastener 52 is installed to secure washer 34 adjacent ferrule 32 and connector assembly 30 to structural member 50. Thus, the flange portion of rib end 14 is fastened, but not clamped, to structural member 50 wherein expansion slot 16 (not shown) can slide about ferrule 32 and beneath washer 34 over sliding surface 36 to accommodate relative movement between the overlying roof panel and structural member 50. Finally, a rib of roof panel 56 has been placed over high cell rib 24 adjacent rib end 14 and fastened to high cell rib 24 by fastener 58.

Figure 4:
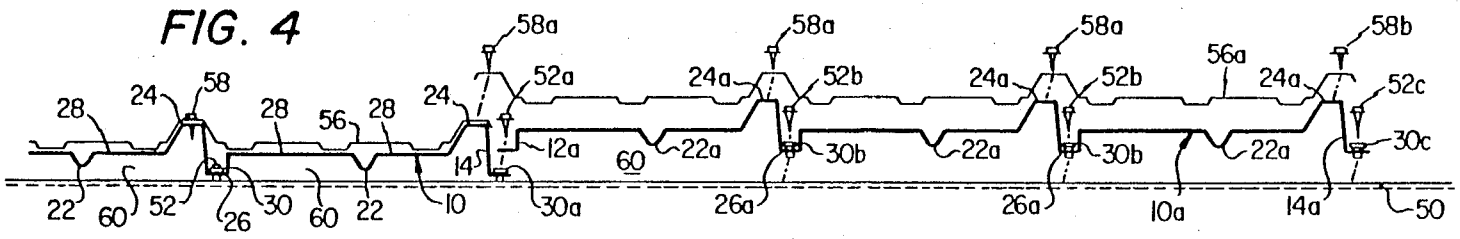
FIG. 4 is an exploded side view of an installation showing a sequence of assembly.

A typical installation sequence for installing subpurlins 10 and overlying roof panels 56 is shown in FIG. 4. At the left side of FIG. 4, a first subpurlin 10 is fastened to structural member 50 at intermediate low cell rib 26 with fastener 52 secured through connecting slider assembly 30. Intermediate bearing stiffeners 22 support spanner sections 28 above support member 50, forming insulation space 60 to accommodate insulating material without compressing the insulating material. Roof panel 56 is secured to high cell ribs 24 of subpurlin 10 with fastener 58. Installation of subpurlin 10 is completed except rib end 14 is not secured to support member 50 and the adjoining roof panel is not secured to high cell rib 24 adjacent rib end 14.

Adjoining subpurlin 10*a* is next installed. Lap end 12*a* is placed adjacent rib end 14. Connector slider assembly 30*a* may be slipped over both flange areas where the ferrule 32 (FIG. 2) passes through the mating expansion slots (not shown) of lap end 12*a* and rib end 14. Fastener 52*a* now fixes slider assembly 30*a* to support member 50. Subpurlin 10*a* is then fixed along support member 50 by successively fastening slider assemblies 30*b* with fasteners 52*b* until rib end 14*a* is reached. If subpurlin 10*a* is the last subpurlin in a given sheet run (i.e., the distance from eave to endlap, eave to ridge, etc.), then installation is completed by installing slider assembly 30*c* with fastener 52*c*. Otherwise the next subpurlin is placed adjacent rib end 14*a*, as hereinabove described.

Roof sheets 56 and 56*a* are fastened to subpurlins 10 and 10*a* with fasteners 58, 58*a*, 58*b* at high cell ribs 24, 24*a*. It will be appreciated that fasteners 58, 58*a*, 58*b* are fixed to raised locations of roof sheet panels 56, 56*a* such that water properly drains away from fasteners 58, 58*a*, 58*b* and does not accumulate in a manner to cause leakage or corrosion of roof panel material adjacent the fasteners.

Figure 5:
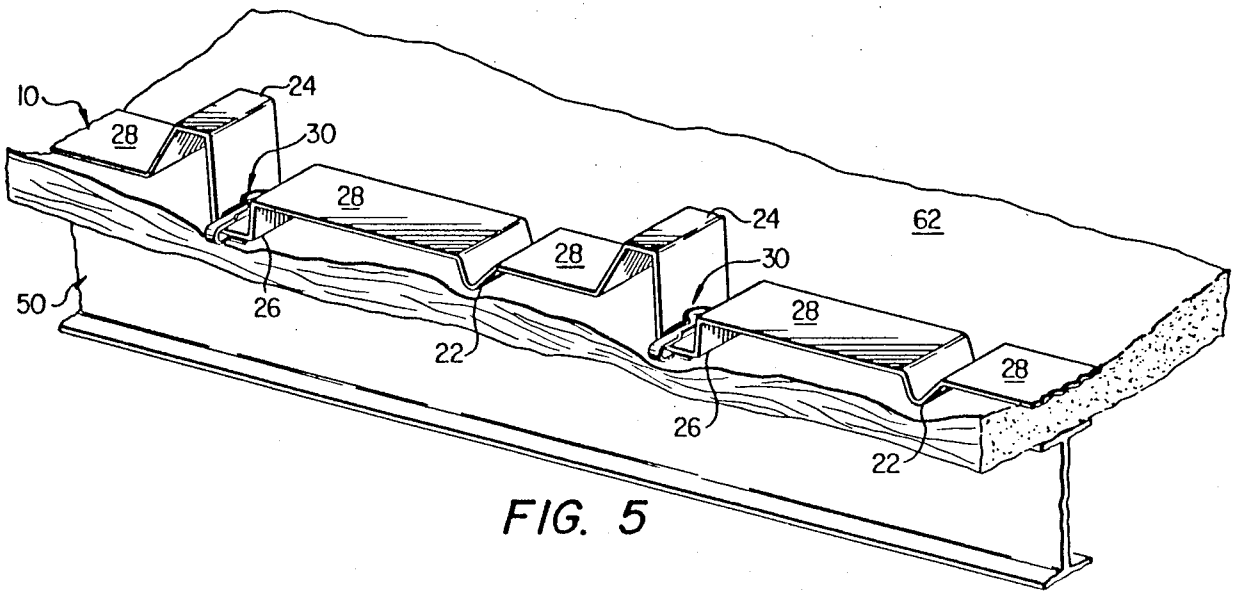
FIG. 5 is a pictorial illustration of a building component assembly incorporating embodiments of the present invention.

A pictorial illustration of a subpurlin assembly according to the present invention and installed on a structural support member having a layer of insulating material is shown in FIG. 5. Subpurlin 10 has been placed along support member 50 and fixed to support member 50 by fasteners fixed through connector slider assemblies 30. Low cell ribs 26 and bearing stiffeners 22 support spanner sections 28 above insulation 62 without any substantial compression of insulation 62. High cell ribs 24 extend above insulation 62 to support overlying roof panels (not shown) above insulation 62. Thus, the overlying roof panels (not shown) will be fastened to subpurlins 10. Subpurlins 10 will be slidingly fixed to support member 5 through connecting slider assemblies 30. Relative thermal movements transverse to support member 50 occur without producing strains on overlapping longitudinal ribs of the overlying roof panels 56 (not shown).

With reference now FIGS. 5–9, further details of the connector 30 will be described. In function, the connector spaces the bottom sliding surface 36 on which the subpurlin 10 rests above the structural assembly member 50. This spacing is achieved by the boss 102 which forms part of the connector 30 and extends downwardly from the material forming the bottom sliding surface 36. As can be seen, the boss 102 tapers downwardly and inwardly at ends 104 to reduce the surface area of the structural bearing surface 40 actually resting on the structural assembly member 50. This minimizes the compression of the insulating material 100 yet provides a stable and secure attachment for the subpurlin on the structural assembly member.

In one embodiment of the present invention, the bottom sliding surface 36 is $3\frac{1}{4}''$ long to accommodate the 3" width of the subpurlin 10. The surface 36 is $1\frac{1}{4}''$ wide to provide an adequate support surface for the subpurlin. The structural bearing surface 40 of the boss 102 is reduced to a contact surface with the structural assembly member 50 of only 5/16" wide by $1\frac{1}{2}''$ long. Thus, by using the boss 102, the area of compression of the insulating material where the connector is attached to the structural assembly member is greatly reduced as best seen in FIGS. 8 and 9. In this embodiment, the height of the boss was approximately $\frac{1}{4}''$, which is approximately the distance from the top of the structural assembly member 50 to the bottom sliding surface 36. With insulation of, for example, 5" uncompressed thickness, the use of the connector minimizes the necessary compression in order to provide a rigid connection between the subpurlins and the structural assembly members 50.

In the preferred embodiment, the connector 30 is stamped from a single sheet of material into the shape as shown in the drawings and described herein.

Figure 10:
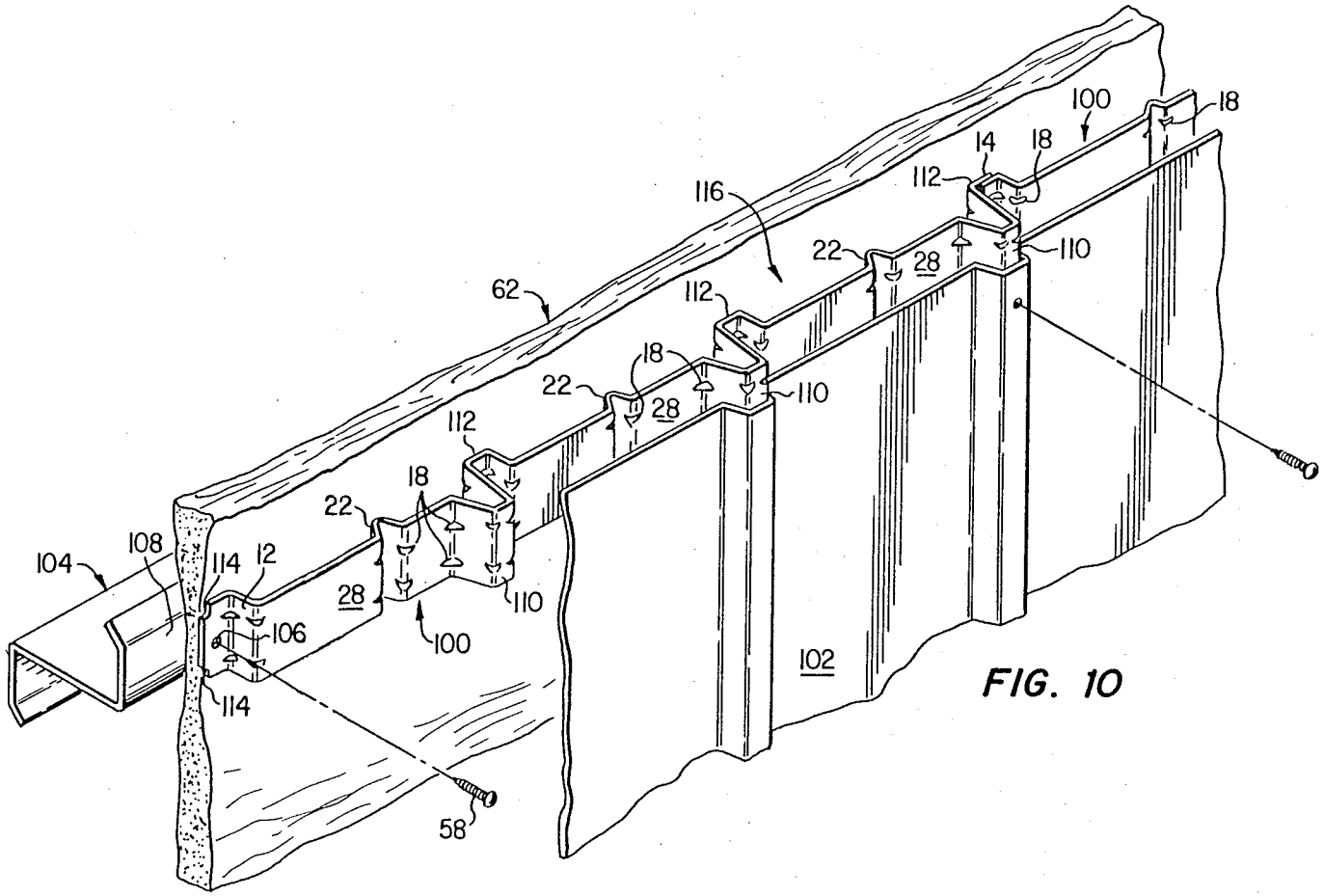
FIG. 10 is a perspective view of a second embodiment of a subpurlin in accordance with the present invention suitable for use in an insulated wall assembly.

With reference now to FIG. 10, a second embodiment of the present invention is illustrated in the form of subpurlin 100. Subpurlin 100 is specifically adapted to mount wall panels 102 to wall support members 104, while providing for insulation between the wall panels and wall support members with insulating material 62. In structure, subpurlin 100 can be identical with subpurlin 10, permitting a single subpurlin to be used either in the wall or roof of a building as desired. However, preferably, subpurlin 100 is identical to subpurlin 10 except that the elongate slots 16 have been replaced by simple circular apertures 106. When the subpurlin 100 is installed in a wall assembly, there is no significant thermal expansion problem and the slots 16 are not necessary.

The wall support members 104 are usually horizontally oriented beams or girts separated by a predetermined vertical distance. Members 104 can be of any suitable construction material, including wood or steel. Each member has an interior face 108 against which the insulation material 62 bears and onto which is secured the subpurlin 100.

As noted, the structure of subpurlin 100 is substantially identical o that of subpurlin 10. Subpurlin 100 includes a lap end 12 and a rib end 14. Subpurlin 100 has structure identical to high cell rib 24, but which is referred to as exterior cell rib 110 as it normally will face the exterior of the building. Subpurlin 100 also has structure corresponding to low cell ribs 26, but which are referred to as interior cell ribs 112 as they face the interior of the building. The ribs 110 and 112 are connected by connecting spanner sections 28 which include intermediate bearing stiffeners 22. Reinforcing embossments 18 are formed in the subpurlin 100 for reinforcement purposes. Also, as with subpurlin 10, when a lap end of one subpurlin 100 is mated with the rib end of another subpurlin 100, the notches 114 formed at the lap end 12 receive the embossments 18 at the rib end of the mating subpurlin to align the subpurlins.

In use, insulating material 62, typically in bat form, is placed between the wall support members 104 and over the exterior faces 108 of the members. A subpurlin 100 is then positioned on the exterior face of the insulating material 62 in alignment with the horizontal position of the member and is fastened to the member through the exterior face 108 by fasteners 58. Fasteners 58 can take any suitable form, including nails, threaded screws and the like.

The configuration of the subpurlin 100 is such to define an insulation space 116 between one plane in which the exterior face 108 and interior cell rib 112 lie and the plane containing the connecting spanner sections 28.

Wall panels 102 of suitable construction can then be secured to the exterior cell ribs 110 of the subpurlin 100, typically to form the outer wall of the building. As with subpurlin 10, the preferred dimensions of subpurlin 100 are a total length of 36" with a 3" width. Thus, a typical construction will have multiple subpurlins 100 extending horizontally end to end.

Besides being a very effective device for insulating between wall support members and wall panels, subpurlins 100 have the additional advantage of being virtually identical to subpurlin 10. Thus, the subpurlins can be manufactured on the same assembly line, reducing the cost per unit through economies of scale.

It is therefore apparent that the present invention is one well adapted to obtain all of the characteristics hereinabove set forth together with other characteristics which will become obvious and inherent from a description of the product itself. It will be understood that certain combinations and subcombinations are of utility and may be obtained without reference to other features and subcombinations. This is contemplated by and is within the scope of the present invention.

What is claimed is:

1. A subpurlin for interconnecting a structural member and a panel, comprising:

a load sustaining elongate member carrying the entire load between the panel and the structural member to support the panel on the structural member, said elongate member defining a plurality of first cell rib areas, each lying in a first plane with each first cell rib area having an aperture formed therethrough, a plurality of second cell rib areas lying in a second plane spaced from said first plane, and spanner sections interconnecting the first and second cell rib areas, the spanner sections lying in a third plane positioned between the first and second planes, said first, second and third planes being parallel, the first and third planes being sufficiently separated to permit thermal insulation to be effectively installed between the subpurlin and structural member when the subpurlin is secured to the structural member at the first cell rib areas.

2. The subpurlin of claim 1 further having bearing stiffeners positioned along said spanner sections to transfer a load exerted from the panel on the subpurlin between the first and second cell rib areas directly to the structural member.

3. The subpurlin of claim 1 wherein said structural member is a wall support member and said panel is a wall panel, the subpurlin being secured to the wall support member on the exterior face thereof for supporting the wall panel.

4. The subpurlin of claim 1 wherein said structural member is a roof structural assembly and said panel is a ribbed roof panel, the aperture in the first cell rib areas defining an expansion slot formed therein extending along the direction of the roof panel ribs when interconnected therewith, the second cell rib areas extending into the ribs of the roof panels, said first and second planes being sufficiently separated to permit the roof panels to be secured to the second cell rib areas through the ribs thereof.

5. A method for forming an insulated wall assembly including a plurality of horizontal wall support beams and wall panels, comprising the steps of:

placing insulating material outside of and over the exterior face of search of the wall support columns;

positioning a first subpurlin exterior of the insulation material for carrying the entire load between the wall panels and support beams, said first subpurlin having a plurality of first cell areas defining apertures therethrough, said first cell rib areas lying in a first plane, a plurality of second cell rib areas lying in a second plane spaced exterior from said first plane, and spanner sections interconnecting the first and second cell rib areas, said spanner sections lying in a third plane positioned between said first and second panels, said first, second and third planes being parallel, said first and third planes being sufficiently separated to permit the insulation material to wall support beam and the first subpurlin when the first subpurlin is fastened to the wall support beam through said apertures; and fastening the wall panel to said second cell areas of said first subpurlin.

6. The method of claim 5 further including the step of interdigitating the lap end of another subpurlin between reinforcing embossments on the rib end of said first subpurlin to resist relative motion therebetween.

7. A method for forming an insulated wall assembly including a plurality of horizontal wall support beams and wall panels, comprising the steps of:

placing insulating material outside of and over the exterior face of each of the wall support columns;

positioning a first subpurlin exterior of the insulation material, said first subpurlin having a plurality of first cell areas defining apertures thereghthrough, said first cell rib areas lying in a first palne, a plurality of second cell rib areas lying in a second plane spaced exterior from said first plane, and spanner sections interconnecting the first and second cell rib areas, said spanner sections lying in a third palne positioned between said first and second planes, said first and third planes being sufficiently separated to permit the insulation material to effectively insulate between the exterior face of the wall support beam and the first subpurlin when the first subpurlin is fastened to the wall support beam through said apertures;

fastening the wall panel to said second cell areas of said first subpurlin; and overlapping a lap end of another subpurlin with the rib end of said first subpurlin so that the apertures in the mating ends are superimposed so that a single fastener can be used to secure the mating ends to the wall support beam.

8. A subpurlin for interconnecting a structural member and a panel, comprising:

an elongate member defining a plurality of first cell rib areas, each lying in a first plane with each first cell rib area having an aperture formed therethrough, a plurality of second cell rib areas lying in a second plane spaced from said first plane, and spaner sections interconnecting the first and second cell rib areas, the spanner sections lying in a third plane positioned between the first and second planes, the first and third planes being sufficiently separated to permit thermal insulation to be effectively installed between the subpurlin and structural member when the supurlin is secured to the structural member at the first cell rib areas;

a first end of the elongate member defining a lap end having opposed notches formed therein on opposite sides of the lap end, the opposite end of the elongate member defining a rib end having a pair of reinforcing embossments proximate opposite edges of the member.

* * * * *